US005085590A

United States Patent [19]

Galloway

[11] Patent Number: 5,085,590

[45] Date of Patent: Feb. 4, 1992

[54] SHIELDED STACKABLE CONNECTOR ASSEMBLY

[75] Inventor: Michael D. Galloway, Hummelstown, Pa.

[73] Assignee: AMP Incorporated, Harrisburg, Pa.

[21] Appl. No.: 606,023

[22] Filed: Oct. 30, 1990

[51] Int. Cl.[5] ..... H01R 4/66

[52] U.S. Cl. ..... 439/95; 439/78; 439/607

[58] Field of Search ..... 439/607-610, 439/92, 101, 108, 94, 95, 55, 78, 554

[56] References Cited

U.S. PATENT DOCUMENTS

| | | | |
|---|---|---|---|
| 4,550,960 | 11/1985 | Asick et al. | 439/108 |
| 4,737,888 | 4/1988 | Bodnar et al. | 439/108 |
| 4,749,357 | 6/1988 | Foley | 439/92 |
| 4,806,107 | 2/1989 | Arnold et al. | 439/101 |
| 4,818,239 | 4/1989 | Erk | 439/55 |
| 4,842,552 | 6/1989 | Frantz | 439/557 |
| 4,878,856 | 11/1989 | Maxwell | 439/540 |
| 4,889,759 | 12/1989 | Taylor et al. | 439/108 |

*Primary Examiner*—David L. Pirlot
*Attorney, Agent, or Firm*—David L. Smith

[57] ABSTRACT

There is disclosed a stacked electrical connector assembly (20) for mounting on a printed circuit board (108). The stacked electrical connector assembly includes a bracket (26) having first and second bracket members (90,96). The bracket has a shield member (28) electrically commoned with at least one of the first and second bracket members. A first electrical connector (22) is mounted on the first and second bracket members with the housing (30) thereof on a first side of the shield member (28). A second electrical connector (24) is mounted on the first and second bracket members with the housing (60) thereof on a second side of the shield member (28). The contacts (44,74) of each of the first and second electrical connectors are interconnectable with traces (110) on the printed circuit board when the assembly is mounted thereon. The shield member (28) extends at least partially between the housings (30,60) of the first and second connectors thereby shielding each of the first and second connectors from the other.

10 Claims, 3 Drawing Sheets

SHIELDED STACKABLE CONNECTOR ASSEMBLY

BACKGROUND OF THE INVENTION

This invention relates to stackable connector assemblies and in particular to a stackable connector assembly providing shielding between the stacked connectors.

Stackable connectors provide a convenient way to provide two interface ports to a circuit board without consuming on the circuit board twice the area required for a single connector. While shielding has been provided to prevent any currents from being induced in the individual connectors or contacts by extraneous electromagnetic radiation, shielding has not been provided between the two stacked connectors to prevent electromagnetic radiation emanating from one of the connectors in a stacked connector from reaching the other of the connectors. Shielding between the two connectors of a stacked connector is most critical in high frequency applications.

SUMMARY OF THE INVENTION

The present invention provides a stacked electrical connector assembly for mounting on a printed circuit board. The stacked electrical connector assembly includes a bracket having first and second bracket members. The bracket has a shield member electrically commoned with at least one of the first and second bracket members. A first electrical connector is mounted on the first and second bracket members with the housing thereof on a first side of the shield member. A second electrical connector is mounted on the first and second bracket members with the housing thereof on a second side of the shield member. The contacts of each of the first and second electrical connectors define an assembly array of contacts that are interconnectable with traces on the printed circuit board when the assembly is mounted thereon. The shield member extends at least partially between the housings of the first and second connectors thereby shielding each of the first and second connectors from the other.

DESCRIPTION OF THE PREFERRED EMBODIMENT

Figure 1:
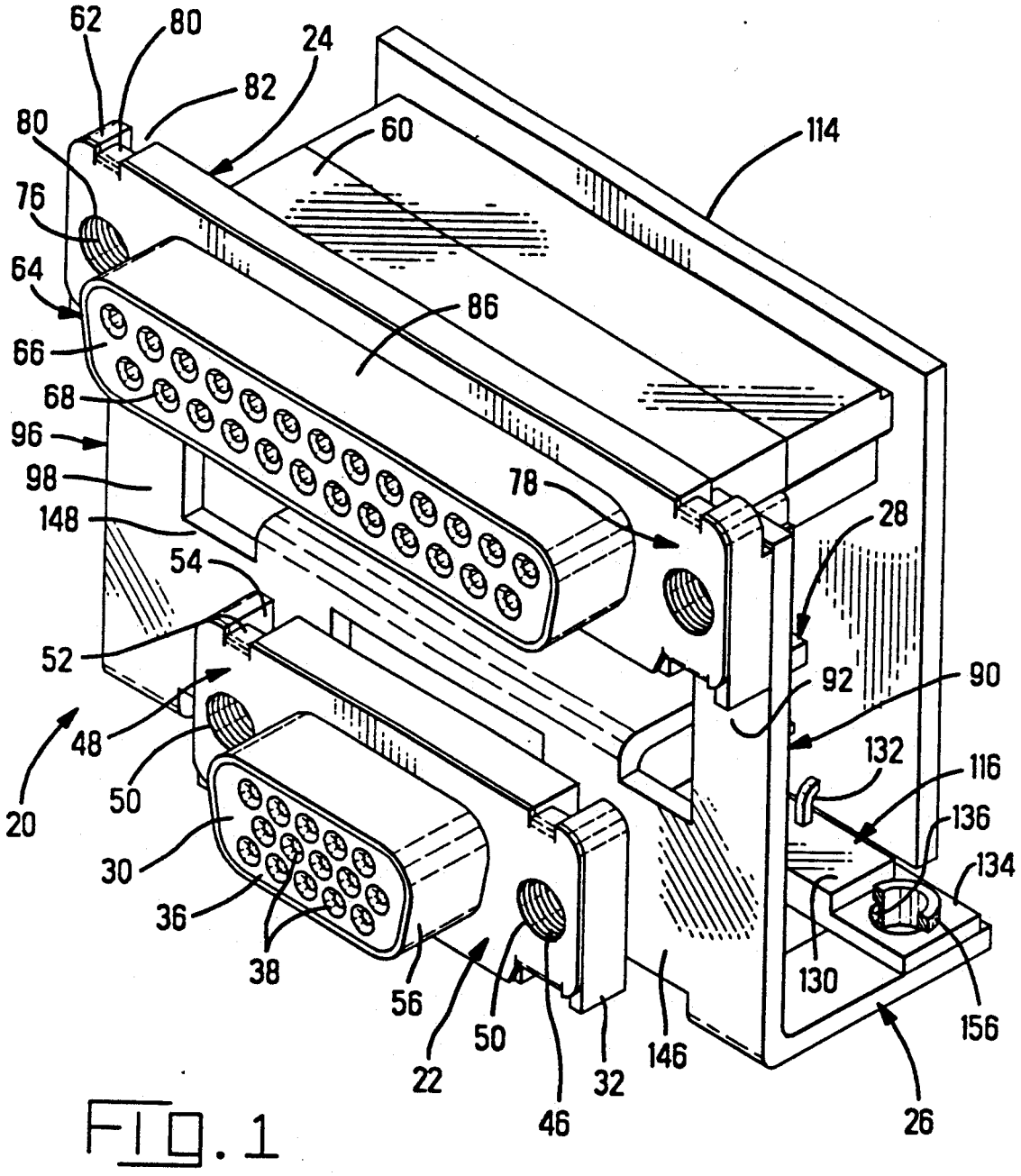
FIG. 1 is an isometric view of a stacked electrical connector assembly including a shielding member between the upper and lower connectors in accordance with the present invention.

A stacked electrical connector assembly 20 in accordance with the present invention is shown in a perspective view of FIG. 1. Stacked electrical connector assembly 20 includes a first electrical connector 22, a second electrical connector 24, a bracket 26 and a shield member 28 providing shielding between the first and second connectors.

First connector 22 has insulative housing 30 molded of a suitable plastic with integral peripheral flange 32. Upstanding from flange 32 is raised portion 34 defining mating face 36 which may provide a polarization feature by having a trapezoidal or subminiature D shape. A plurality of contact receiving passages 38 extend rearwardly from mating face 36 with contacts 40 secured therein. Contacts 40 include a mating portion 42, which may be a pin or receptacle, a solder tail 44 and a retention portion therebetween. The solder tails 44 of contacts 40 in first connector 22 are bent at right angles to the mating portion 42. Flange 32 has mounting apertures 46 at opposite ends thereof for securing a first complementary connector thereto.

Electrically conductive shell 48 has a similar outer profile to flange 32 with mounting apertures 50 aligned with apertures 46. Lugs 52 on the upper and lower edges of shell 48 fold into recesses 54 in flange 32 to secure shell 48 to housing 30. Shroud 56 extends upwardly from the flat portion of shell 48 and conforms to and encloses the forward raised portion 34 of housing 30. Shroud 56 shields the mating face and contacts 40 through a portion of housing 30 extending rearward from mating face 36 to flange 32.

Second connector 24 is similar to first connector 22 and has insulative housing 60 molded of a suitable plastic with integral peripheral flange 62. Upstanding from flange 62 is raised portion 64 defining mating face 66 which may provide a polarization feature by having a trapezoidal or subminiature D shape. A plurality of contact receiving passages 68 extend rearwardly from mating face 66 with contacts 70 secured therein. Contacts 40 include a mating portion 72, which may be a pin or receptacle, a solder tail 74 and a retention portion therebetween. In the preferred embodiment, the solder tails 74 of contacts 70 extend rearwardly of housing 60, although the invention is not limited thereto. Flange 62 has mounting apertures 76 at opposite end thereof for securing a second complementary connector thereto.

Electrically conductive shell 78 has a similar outer profile to flange 62 with mounting apertures 80 aligned with apertures 76. Lugs 82 on the upper and lower edges of shell 78 fold into recesses 84 in flange 62 to secure shell 78 to housing 60. Shroud 86 extends upwardly from the flat portion of shell 78 and conforms to and encloses the forward raised portion 64 of housing 60. Shroud 86 shields the mating face and contacts 80 through a portion of housing 60 extending rearwardly from mating face 66 to flange 62.

Bracket 26 is manufactured of electrically conductive material, in the preferred embodiment stamped steel, but could be manufactured of an insulative material and metallically coated to provide electrical conductivity. Bracket 26 has an L-shaped first end member 90 comprising a vertical portion 92 and a horizontal portion 94 and an L-shaped second end member 96 comprising a vertical portion 98 and a horizontal portion 100. Each vertical portion 92,98 has an upper aperture 102 spaced to align with mounting apertures 76 and 80 of second connector 24. Second connector 24 is secured to bracket 26 by any known electrically conductive means such as rivets, or in accordance with the preferred embodiment a drop-in insert 104 in accordance with the teaching of U.S. Pat. 4,889,502, the disclosure of which is hereby incorporated by reference. As shown in FIG.

Figure 2:
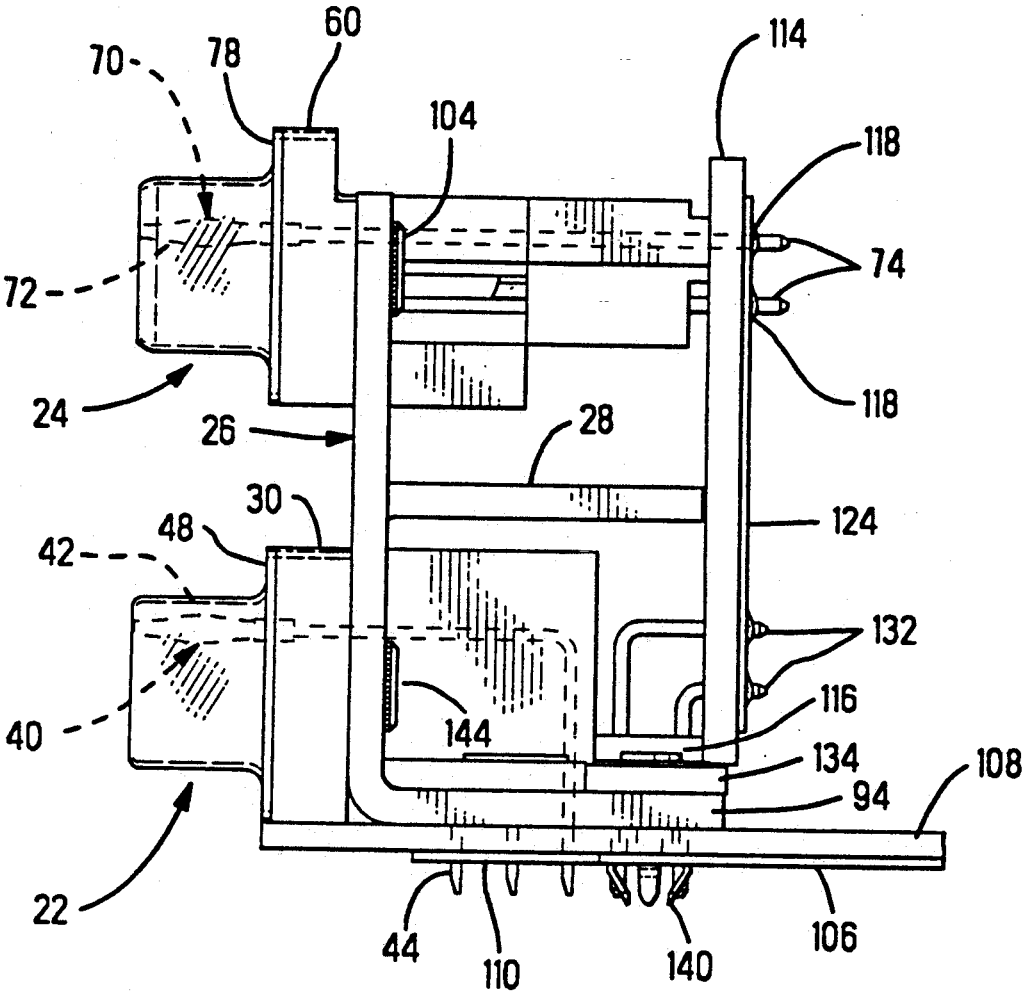
FIG. 2 is a side view of the stacked electrical connector assembly of FIG. 1 with the added feature of a board lock.
Figure 3:
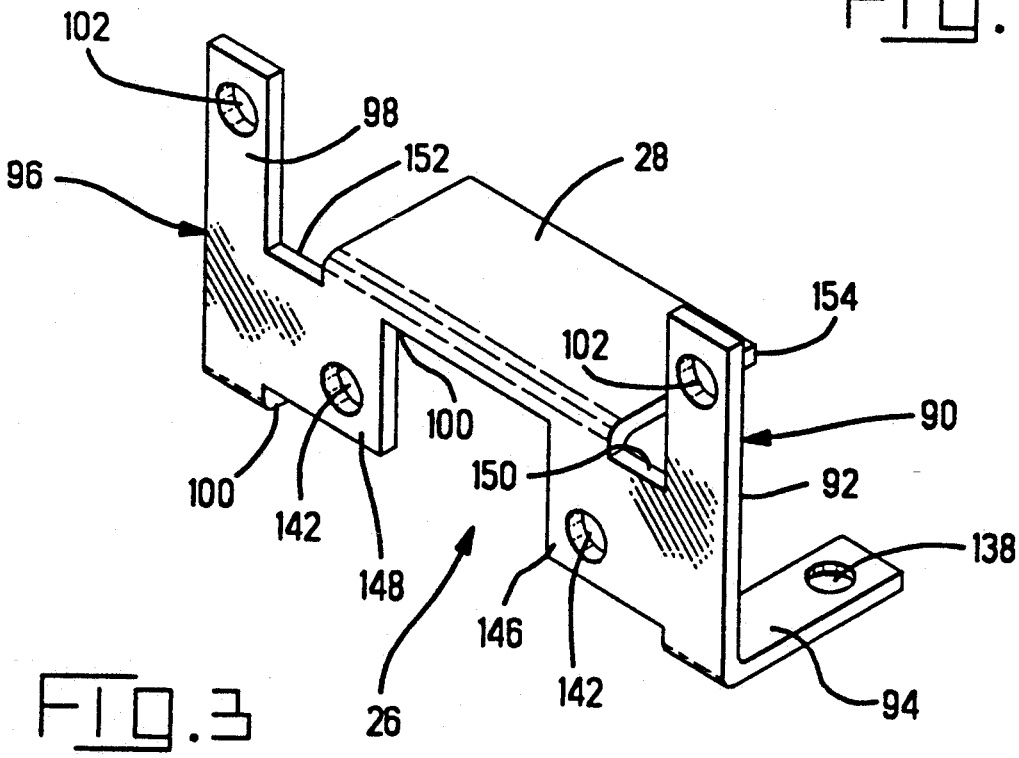
FIG. 3 is an isometric view of the bracket of the assembly of FIG. 1.
Figure 4:
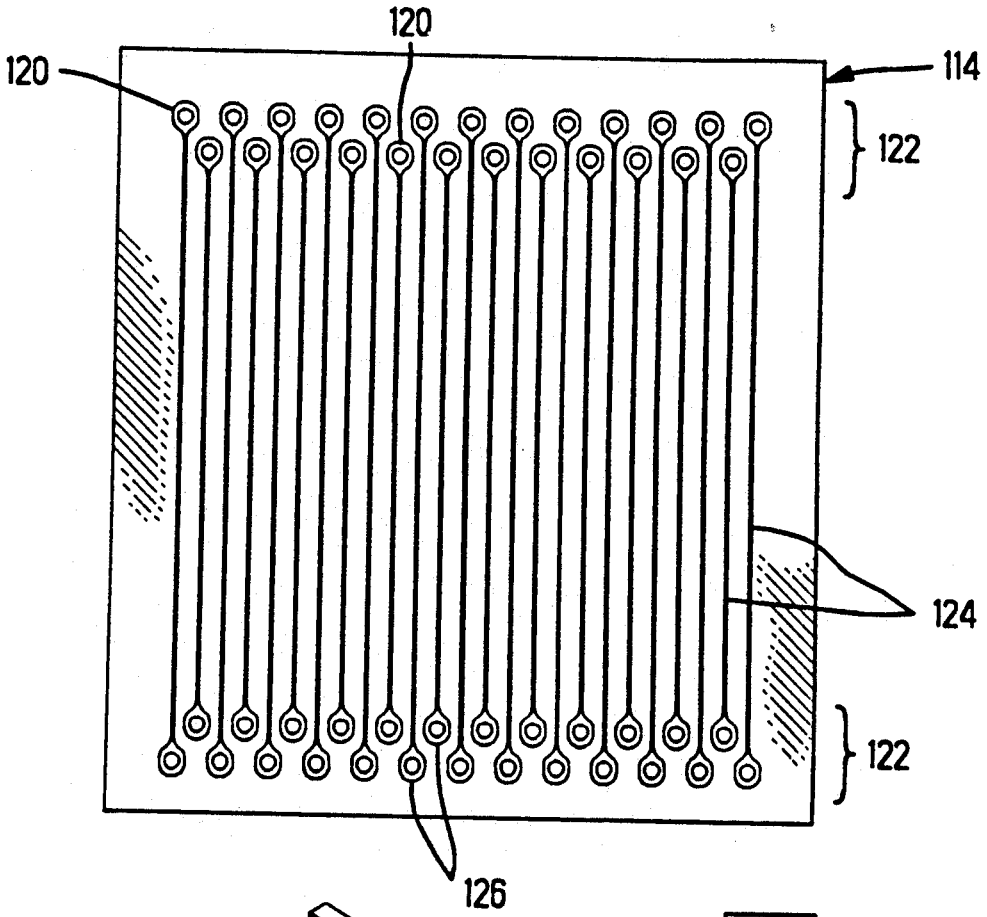
FIG. 4 is a view of the traces on the intermediate circuit board.

2, inserts 104 may be internally threaded with knurling on the exterior of the shank providing an interference fit when received in aperture 102 to electrically common shell 78 with bracket 26 to provide a ground path from shell 78 to a ground 106 on the circuit board 108 shown in FIG. 2 on which the assembly is mounted.

Each of contacts 70 of second connector 24 are interconnectable with respective conductive traces 110 on circuit board 108 when the assembly is mounted thereon. While any known method may be used such as long solder tails bent at a right angle to extend from housing 60 to engage traces 110 on circuit board 108, or the use of contact extensions to interconnect solder tail 74 to traces 110. In the preferred embodiment contacts 70 are interconnected to traces 110 using an intermediate circuit board 114 and a right angle pin header 116. Solder tails 74 of second connector 24 are soldered at 118 to respective ones of the solder pads 120 on the upper array 122 on intermediate circuit board 114. Traces 124 thereon interconnect respective solder pads 120 of the upper array 122 to corresponding solder pads 126 of the lower array 128.

Right angle pin header 116 comprises an elongate insulative housing 130 through which extend a plurality of right angle pins 132. The pins are typically positioned in the same configuration to result in the same footprint as solder tails 74 of second connector 24, although the invention is not limited thereto. Pins 132 each project from both the upper and lower surfaces of housing 130. Each end of housing 130 is formed with a mounting flange 134 having a mounting aperture 136 therein. Apertures 136 are spaced to align with mounting apertures !38 in the horizontal portions 100 of first and second end members 90 and 96. The portion of pins 132 extending upwardly from the upper surface of housing 130 are bent to form a right angle to be received in through holes in intermediate circuit board 114 and to be soldered to respective pads 126 in lower array 128. In this manner, the contacts of second connector 24 are interconnectable with corresponding traces on printed circuit board 108 when the assembly is mounted thereon. Boardlocks 140 in accordance with U.S. Pat. No. 4,842,552, the disclosure of which is hereby incorporated by reference, are received through apertures 136 and 138 thereby securing pin header 116 to bracket 26 and providing means for completing a ground path to a ground 106 on circuit board 108 when the assembly is mounted thereon. Boardlocks 140 are receivable in board lock receiving apertures in board 108 to secure the stacked assembly to board 108 and complete the ground path to a ground 106 on board 108. A separate rivet 156, shown in FIG. 1, may be used to secure pin header 116 to bracket 26 in addition to or in place of boardlock 140.

Each vertical portion 92,98 of bracket 26 also has a lower aperture 142 spaced to align with mounting apertures 46 and 50 of first connector 22. First connector 22 is secured to bracket 26 by any known electrically conductive means, such as drop-in inserts 144. Drop-in inserts 144 may be internally threaded and are substantially the same as and provide the same function as inserts 104. If first connector 22 is smaller in size than second connector 24, lower apertures 142 may be in a lateral flange portion 146,148 of first and second end members 90,96.

Shield member 28 provides a shield that extends at least partially between housing 30 of first connector 22 and housing 60 of second connector 24 to provide shielding therebetween, as best seen in FIGS. 1 and 2. Shield 28 is electrically commoned to a common ground with other grounds in the stacked connector assembly 20. Shield member 28 may be electrically commoned with first or second end members 90,96. In the preferred embodiment, shield member 28 is formed from the same metal blank as first and second end members 90,96. Shield member 28 thus forms an integral part of bracket 26, although the invention is not limited thereto. The shield member could be a separate member secured to or electrically commoned with the bracket. In the preferred embodiment, shield member 28 is integral with the upper surface 150,152 of lateral flange portions 146 and 148, respectively, and is bent to extend substantially perpendicular to vertical portions 92,98 as well as substantially parallel to horizontal portions 94,100. The rear edge 154 of shield member 28 may extend substantially to intermediate circuit board 114 as best seen in FIG. 2 to provide the most effective shielding.

Figure 5:
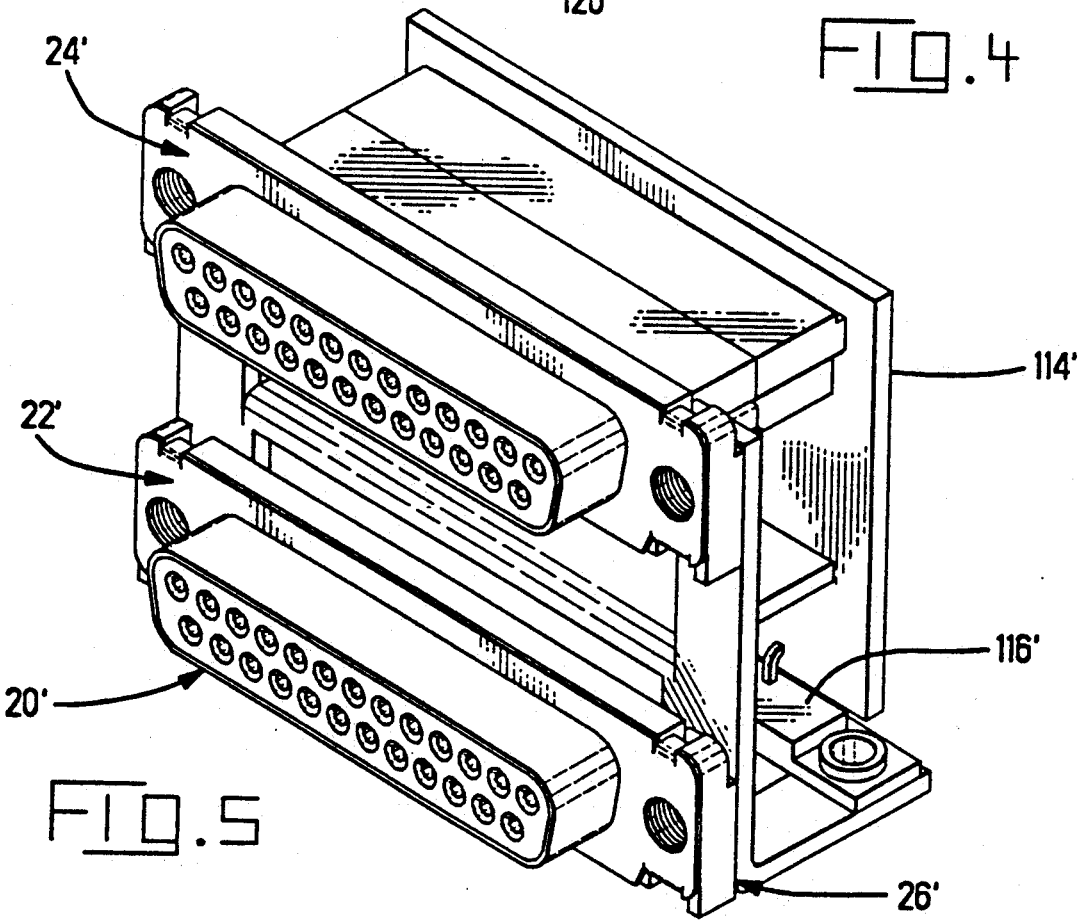
FIG. 5 is an isometric view of an alternate embodiment stacked electrical connector assembly providing shielding between two connectors of the same size.

Bracket 26 can be dimensioned to support any combination of sizes of first and second connectors at any desirable vertical spacing. FIG. 5 shows an alternate embodiment bracket 26' sized to support the same size first 22' and second 24 connectors.

I claim:

1. A stacked electrical connector assembly for mounting on a circuit board, comprising:

a bracket having first and second bracket members, said bracket having a shield member electrically commoned with at least one of said first and second bracket members;

a first electrical connector having a housing with terminals secured therein, said first electrical connector terminals interconnectable with traces on the circuit board when the assembly is mounted thereon, said first electrical connector secured to said first and second bracket members on a first side of said shield member; and a second electrical connector having a housing with terminals secured therein, said second electrical connector terminals interconnectable with traces on the circuit board when the assembly is mounted thereon, said second electrical connector secured to said first and second bracket members on a second side of said shield member with the shield member extending at least partially between the housings of said first and second connectors, said first electrical connector terminals and said second electrical connector terminals defining collectively an assembly array of terminals that are simultaneously positionable proximate traces on the circuit board when the assembly is mounted thereon, whereby the portion of the shield member extending between the housings of the first and second connectors shields each of the first and second connectors from the other.

2. A stacked electrical connector assembly as recited in claim 1, wherein the shield member is electrically commoned with both the first and second bracket members.

3. A stacked electrical connector assembly as recited in claim 1, wherein the shield member being electrically commoned with at least one of said first and second bracket members is achieved by being an integral part thereof.

4. A stacked electrical connector assembly as recited inn claim 1, further comprising a board lock for securing the assembly too the circuit board.

5. A stacked electrical connector assembly for mounting on a circuit board, comprising:

a first electrical connector having terminals and defining first and second ends;

a second electrical connector having terminals and defining first and second ends, the terminals of said first and second electrical connectors defining collectively an assembly array of terminals that are simultaneously positionable proximate traces on the circuit board when the assembly is mounted thereon;

bracket means for stacking the first connector over the second connector; and shield means between the first and second electrical connectors for providing shielding therebetween, said shield means electrically commoned with said bracket means, said shield means groundable to a ground on a circuit board on which the stacked electrical connector assembly is mounted.

6. A stacked electrical connector assembly as recited inn claim 5, wherein the shield means is integral with the bracket means.

7. A stacked electrical connector assembly as recited in claim 5, wherein the bracket means is electrically conductive and the shield means is electrically commoned with the bracket means.

8. A stacked electrical connector assembly as recited in claim 5, wherein the first and second ends of each of the first and second connectors are secured to said bracket means.

9. A stacked electrical connector assembly for mounting on a circuit board, comprising:

bracket means for supporting stacked first and second electrical connectors;

shield means electrically commoned with said bracket means for providing shielding between the stacked connectors;

a first electrical connector having a housing with terminals secured therein, said first electrical connector secured to said bracket means with the housing thereof on a first side of said shield means, said terminals inn said first connector interconnectable with the circuit board when the assembly is mounted thereon;

a second electrical connector having a housing with terminals secured therein, said second electrical connector secured to said bracket means with the housing thereof on a second side of said shield means, said terminals in said second connector interconnectable with the circuit board when the assembly is mounted thereon, said shield means extending at least partially between the housings of the first and second connectors;

a pin header secured to said bracket means, said pin header having an insulating housing through which extend a plurality of pins; and an intermediate circuit board having a plurality of traces thereon, each of said traces electrically commoned with both a respective contact in said second connector and a respective pin in said pin header, whereby that portion of the shield means extending between the housings of the first and second connectors provides shielding therebetween.

10. A stacked electrical connector assembly as recited in claim 9, wherein the shield means extends to proximate the intermediate circuit board.

* * * * *